US005324178A

United States Patent [19]

Escaravage

[11] Patent Number: 5,324,178

[45] Date of Patent: Jun. 28, 1994

[54] MOTOR DRIVEN AIR PULSATOR AND METHOD FOR THE ASSEMBLY THEREOF

[75] Inventor: Gérard Escaravage, Valentigney, France

[73] Assignee: ECIA - Equipments et Composants pour l'Industrie Automobile, Audincourt, France

[21] Appl. No.: 74,269

[22] Filed: Jun. 8, 1993

Related U.S. Application Data

[63] Continuation of Ser. No. 575,598, Aug. 19, 1990, abandoned.

[30] Foreign Application Priority Data

Sep. 4, 1989 [FR] France ..... 89 11541

[51] Int. Cl.[5] ..... F04B 17/00; F04B 35/04

[52] U.S. Cl. ..... 417/423.1; 417/423.14

[58] Field of Search ..... 417/423.1, 423.15, 423.14, 417/423.12, 360; 415/127; 418/107

[56] References Cited

U.S. PATENT DOCUMENTS 2,014,507 9/1935 Price ..... 417/423.15
2,542,121 2/1951 Earl ..... 417/423.1
3,102,681 9/1963 Nilsson ..... 418/107
3,365,123 1/1968 Seabury .
4,767,285 8/1988 Jyoraku ..... 417/423.12

FOREIGN PATENT DOCUMENTS 977956 4/1951 France .
2624924 12/1987 France .
1015486 8/1962 United Kingdom .
0911111 11/1962 United Kingdom .

*Primary Examiner*—Richard A. Bertsch
*Assistant Examiner*—Alfred Basichas
*Attorney, Agent, or Firm*—Emmanuel J. Lobato; Robert E. Burns

[57] ABSTRACT

The motor-driven pulsator comprises, inter alia, a turbine (10) having a distributor (11) and an air-agitating member (12), and an electric motor (20) having a casing (200), a shaft (210) and a connector (220). This motor-driven pulsator comprises a mounting arrangement (30) consisting of a passage (31) permitting the unrestricted introduction of the member (12) into the distributor (11), an orientation means (32) for fixing, as desired, the relative rotational positions of the casing (200) and of the distributor (11) and securing elements (33) for joining the distributor (11) and motor (20).

6 Claims, 2 Drawing Sheets

FIG. 2
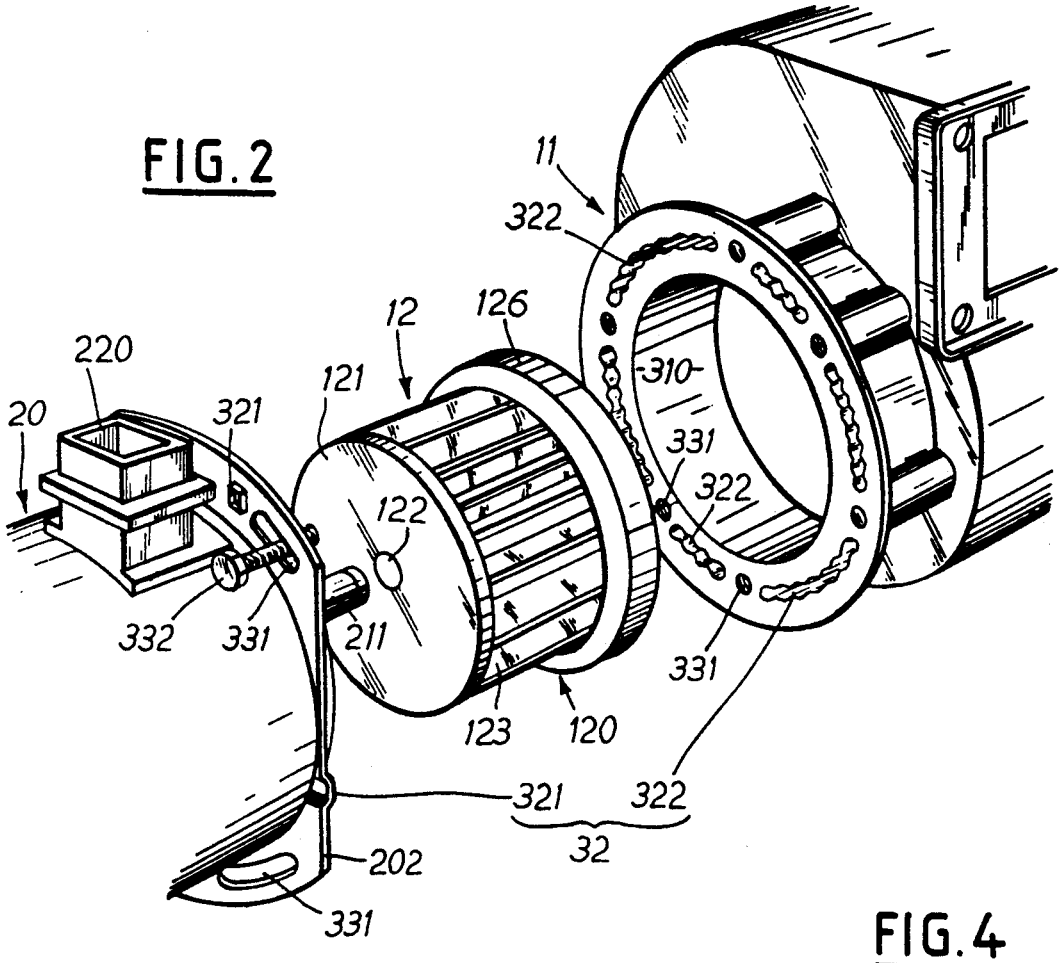
FIG. 4
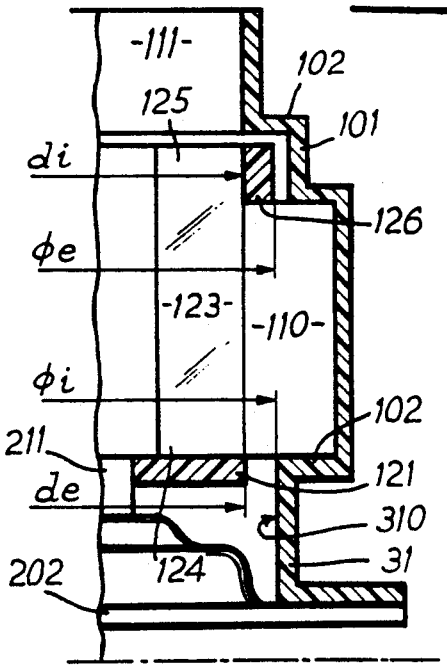
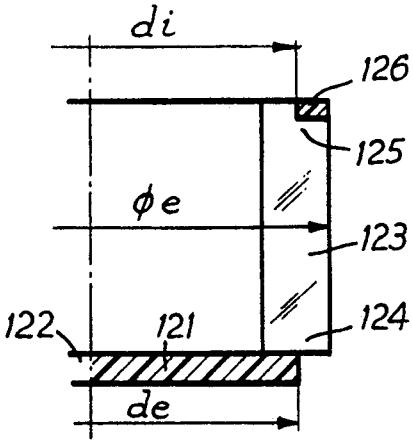
FIG. 3

MOTOR DRIVEN AIR PULSATOR AND METHOD FOR THE ASSEMBLY THEREOF

This is a continuation of application Ser. No. 07/575,598, filed Aug. 31, 1990, now abandoned.

The invention relates to motor-driven pulsators in particular, to those intended to be used in motor vehicles.

In many industrial sectors, it is necessary to direct airflows onto equipment in order to ensure the ventilation and/or the air-conditioning thereof. This is the case, for example, in the automotive industry, where motor-driven pulsators of this type are used, in particular for the air-conditioning of compartments reserved for passengers, for supplying air to engine superchargers or even for cooling certain carburettors or other hot spots of the engine environment.

As is known, this type of motor-driven air pulsator usually comprises, on the one hand, a turbine having a distributor and an air-agitating member, such as for example a bladed wheel, and, on the other hand, an electric motor for driving this member. The turbines are usually of the outward-flow type and possess a hollow enclosure having a chamber with spiral volute, into which opens an inlet orifice, coaxial with the axis of the spiral of the volute, for admitting air, and a tangential outlet orifice for discharging the admitted air. The bladed wheel, which usually rotates in the chamber on an axis of rotation which is in principle coincident with the axis of the spiral volute, often takes the form of a squirrel cage, the axial faces or bases of which are displaced in their respective planes in the immediate vicinity of the inner surfaces of the end walls of the turbine distributor chamber which are at least partly opposite one another. It has been established that the efficiency of such a motor-driven air pulsator depends to a large extent on the accuracy of the position of the axial faces of the bladed wheel relative to these surfaces of the chamber walls which face them. The greater the distance, or clearance or play, which exists between these opposite faces and surfaces, the more the efficiency decreases. It is therefore advantageous to keep the gap between these faces and surfaces to the smallest possible value.

The assembly of the conventional motor-driven air pulsators presents great difficulties since, customarily, the distributor is made of a hollow enclosure having a base and closed by a cover, consisting of one of the end walls, which provides access to the chamber. Either the base or the cover is pierced with an opening for the passage of the motor shaft on which the bladed wheel to be driven is fixed. In this type of solution, the electric motor is first joined either to the base or the cover of the turbine distributor which is without its other part and then the bladed wheel is mounted on the end piece of the motor shaft which is visible on the other side, base or cover this part, being enclosed between motor and bladed wheel, and the cover is finally closed again in such a manner that the bladed wheel is accommodated in the chamber. The housing and the cover are secured to one another by screwing, adhesive bonding, welding, resilient interlocking, etc.

Keeping such a gap to an absolute minimum causes great difficulties. In fact, owing to the existence of manufacturing tolerances of the bladed wheel and the distributor enclosure in which the chamber is situated, and also to the existence of inaccuracies which result from the increase in dimensions following the fitting of such a wheel to the motor shaft, then of the motor with the wheel to the turbine distributor, it can be seen that, if it is desired that such a motor-driven air pulsator should work properly all the time, very strict tolerances and extreme care are required. Added to this is also the eccentricity which the bladed wheel may exhibit on its axis, thereby having a further adverse effect not only on the clearance but also on both the static and dynamic balance of the motor-driven pulsator.

It will thus be immediately clear that such a solution permits neither the accuracy nor the automation of the mounting and assembly.

The object of the invention is to overcome most of the disadvantages mentioned above in brief.

The invention relates to a motor-driven air pulsator, the structure of which makes it possible to ensure accurate mounting both as regards the increase in dimensions and the balance, and also a relative degree of automation of its assembly.

The subject of the invention is a motor-driven air pulsator, in particular for a motor vehicle, consisting of a turbine having, on the one hand, a distributor which comprises a hollow body having a side wall virtually parallel to a given direction and having end walls virtually perpendicular to this direction and in which these walls together delimit an inner chamber into which opens an inlet orifice for admitting air and an outlet orifice for discharging the admitted air, and in which this body carries a fixing and connecting device intended to link this outlet orifice to an air-distribution circuit, and having, on the other hand, an air-agitating member inscribed in a circular cylinder of specified external diameter and capable of rotating in this chamber on an axis parallel to this specified direction, and also consisting of an electric motor intended to drive this air-agitating member, which comprises a casing having a housing and end plates intended to carry bearings, a shaft rotating in these bearings and exhibiting an end piece which projects from one of these plates in order to receive this air-agitating member, and a connector carried by this casing. This motor-driven pulsator is remarkable in that it comprises an arrangement which is intended to ensure the mounting of this casing on this body and which consists of a passage carried by one of these end walls and circumscribing a circular cylinder of axis coaxial with this given axis and the internal diameter of which is at least equal to this specified external diameter so as to permit unrestricted insertion of this air-agitating member into this chamber by a translation parallel to this given direction, of an orientation means carried partly by this body and partly by this casing so as to be able to fix, as desired, the relative rotational positions in accordance with this given direction of this turbine and motor, and also of securing elements for permanently joining this turbine and motor.

The subject of the invention is also a method for the assembly of a motor-driven air pulsator, in particular for a motor vehicle, of the type indicated above, and according to which the air-agitating member is fitted onto the end piece of the motor shaft, this air-agitating member thus fitted on the end piece is positioned and fixed in such a manner that the distance separating at least one of its axial faces from that end plate of the motor which is closest to it is within the predetermined tolerance range, at least one of the axial faces of this air-agitating member is dressed so as to make it perpendicular to the axis of rotation of this shaft and so as to situate it at the nominal distance from this end plate, allowing for machining accuracy, the motor thus equipped with the air-agitating member is positioned on the turbine distributor body by fitting this member into the passage of the mounting arrangement, the casing of the electric motor and the distributor body are oriented in relative rotation on this axis in order to give them the assigned position, this end plate is brought to bear against this body and this body and casing are fixed to one another in order to keep them in this position.

Other features and advantages of the invention will become apparent on reading the description and the claims which follow, and also on examining the figures of the drawing, given merely by way of example, in which:

FIG. 2 is a partial view similar to that of FIG. 1 of another embodiment according to the invention;

FIG. 3 is a partial detail view of the turbine wheel of the motor-driven air pulsator of FIG. 1 according to the invention;

Figure 1:
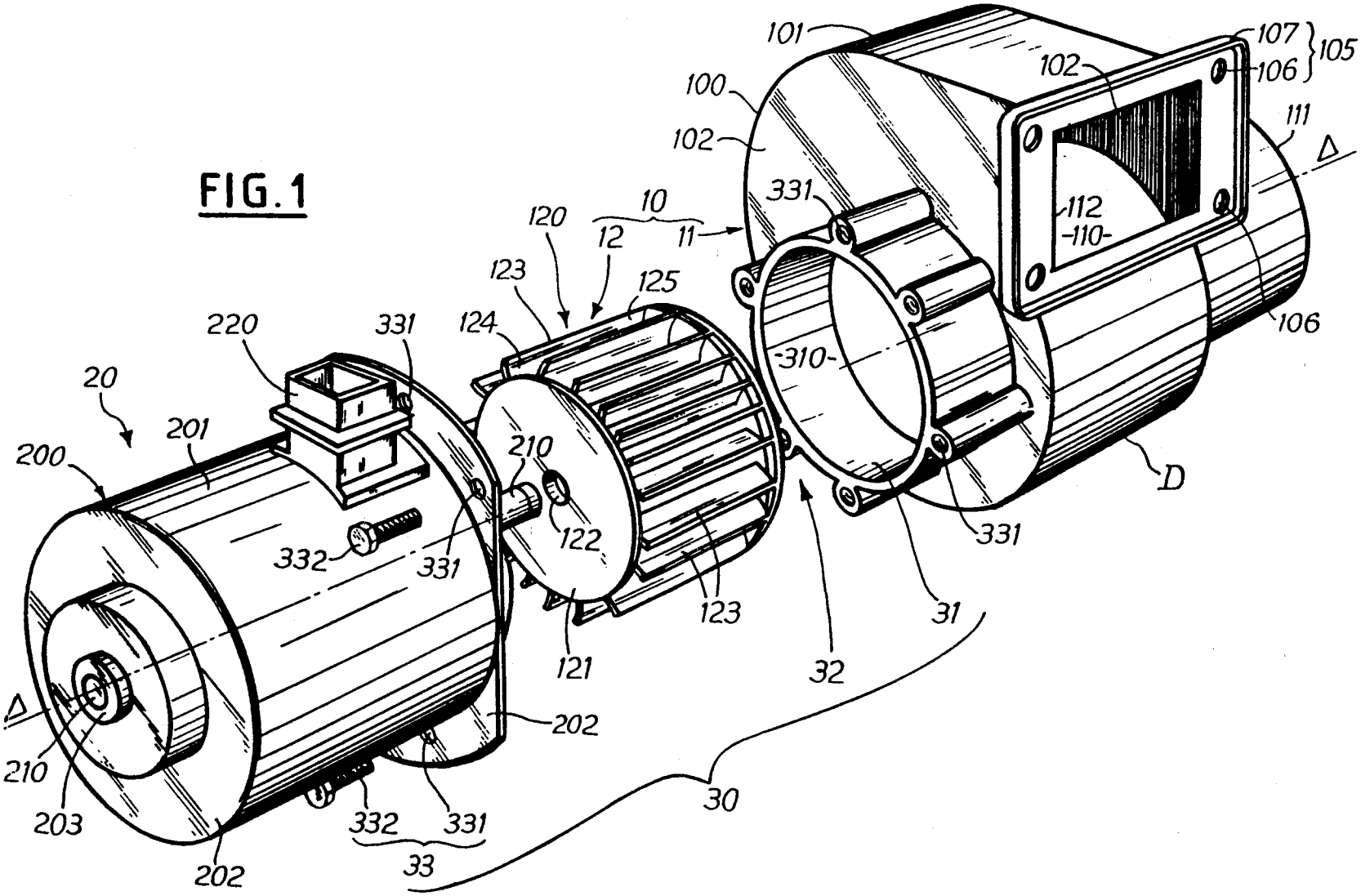
FIG. 1 is a diagrammatic exploded perspective view of one embodiment of a motor-driven air pulsator according to the invention.

and FIG. 4 is a partial detail view similar to that of FIG. 3 of the embodiment of FIG. 2.

In the text which follows, only that which refers directly or indirectly to the invention will be described. A person skilled in the art in question will be able to obtain any further information from the current conventional solutions at his disposal to deal with particular problems with which he is confronted.

In the rest of the description, a single reference numeral is used in every case to designate a homologous element, irrespective of the embodiment.

As can be seen, a motor-driven air pulsator according to the invention comprises a turbine 10 having a distributor 11 in which an air-agitating member 12 may be displaced. This motor-driven air pulsator also comprises an electric motor 20 intended to drive the air-agitating member. In order to join the turbine and the electric motor, a mounting arrangement 30 is used.

In order to facilitate the description, each of the constituents of the motor-driven air pulsator according to the invention will be described successively before the assembly technique thereof is described.

As can be observed, the distributor 11 is made of a hollow body 100 having a side wall 101 parallel to a given direction D and end walls 102 virtually perpendicular to this given direction. These side and end walls together delimit a chamber 110. This chamber has, for example, the configuration of a spiral volute of axis Δ (delta) parallel to this given direction.

Into this chamber 110 opens an inlet orifice 111 for admitting air and an outlet orifice 112 for discharging the admitted air. In the embodiment shown, this inlet orifice 111 takes the form of a cylindrical mouthpiece coaxial with the axis of the chamber. The outlet orifice 112, for its part, in this case takes the form of a rectangular window pierced tangentially in the side wall 101.

The distributor is also provided with a fixing and connecting device 105 of any conventional current type, preferably situated in the vicinity of the outlet orifice so as to be able to link the latter to a distribution circuit (not shown). For example, this device comprises holes 106 intended to receive screws or the like and a peripheral sealing lip 107 or such like.

The air-agitating member 12 takes the form, for example, of a wheel 120, the configuration of which approximately resembles a squirrel cage. This wheel comprises a preferably circular base 121 pierced at its centre with a bore hole 122. This bore hole is intended to receive the end piece of a motor shaft so as to be able to be fixed thereto both in rotation and in translation, as will be understood hereinbelow. Longilinear blades 123 are mounted on this base virtually parallel to the axis of the bore hole. Each of these blades 123, preferably of curved cross-section as illustrated, exhibits a foot 124 linked to the base and a head 125. As can be observed, the heads 125 of all these blades are joined by a collar 126. As can be observed in particular in FIGS. 3 and 4, only one part of each of these feet is joined to this base and similarly only one part of each of these heads is joined to this collar. For reasons which will become apparent hereinbelow, this base 121 has a circle of given external diameter $d_e$ or is inscribed in such a circle. The collar 126, which is preferably toroidal in the shape of an annulus or ring, has a given internal diameter $d_i$ or circumscribes a circle of such diameter. It will be observed that, in accordance with the invention, the external diameter $d_e$ of the base is at least equal to the internal diameter $d_i$ of the collar and very close to it.

As can be seen, the electric motor 20 comprises a casing 200 made of a housing 201 to which are fastened, in any appropriate conventional manner, two end plates 202 each carrying a bearing 203. These bearings are intended to receive a shaft 210 which exhibits an end piece 211 protruding from one of the plates. If necessary, this end piece has a non-circular for example square, cross-section for receiving a bore hole of complementary cross-section so as to ensure the fixing in rotation. A key, pin or an inserted screw is thus able to perform the same function equally well, as is conventional. This motor also comprises a connector 220, for example fastened to the housing 201. This connector makes it possible to provide the electrical link with the commutation means of the motor such as the collector and the brushes which bear upon it.

The mounting arrangement 30 of the turbine 10 and of the motor 20 comprises a passage 31, an orientation means 32 and securing elements 33.

As can be seen, the passage 31 has an inner surface 310 which circumscribes a circular cylinder, the axis of which is coaxial with the axis Δ (delta) and the diameter $\phi_i$ of which is at least equal to the diameter $\phi_e$ of the cylinder which circumscribes the air-agitating member 12. As can be observed, this passage, which is open at the end, is carried by one of the end walls 102 of the body 100 of the turbine distributor 11, virtually perpendicular thereto.

The orientation means 32 is carried partly by the body 100 and partly by the casing 200 so as to be able to fix, as desired, the relative rotational positions on this axis Δ (delta) of this turbine 10 and motor 20. The orientation means 32 comprises at least one protuberance 321 carried either by the body or the casing, for example in the form of a plunged boss provided on one of the end plates 202. The orientation means 32 comprises at least one receptacle 322 carried by the other one of this body and casing, for example by one of the end walls of the body or preferably on the periphery of the free edge of the passage 31. These protuberances and receptacles are intended to fit into one another. If these protuberances and receptacles are numerous, they are arranged along a circle centred on the axis Δ(delta) of the chamber which, in principle, coincides with the axis of rotation of the motor shaft. These protuberances and receptacles are distributed regularly or otherwise around this circle, but in accordance with a specified angular pitch for reasons which will be readily understood.

The securing elements 33 of the electric motor and of the turbine consist of holes 331, at least some of which are tapped, provided, for example, on one of the end walls 102 in the vicinity of the passage 31 and on one of the end plates 202. These securing elements also comprise screws 332 which fit into these holes.

According to an advantageous embodiment, the orientation means 32 and the securing elements 33 are common to one another. In this case, the protuberances consist of the screws and the receptacles consist of these holes. This is illustrated in FIGS. 1 and 2. For this embodiment, the angular pitch is 60° since 6 receptacles or holes are used.

According to an alternative embodiment depicted in FIG. 2, these receptacles 322 are cavities arranged in a circle in the vicinity of that end wall 102 of the body 100 which is intended to face that end plate 202 which carries the protuberances 321. For this embodiment, the angular pitch is 9° since 40 cavities are used.

The motor-driven air pulsator according to the invention is assembled as is shown clearly in the exploded perspective view of FIG. 1 in particular. Preferably, the commutation means of the motor are placed in the casing 200 and are adjacent to one of the end plates 202, that which is intended to be brought to bear against the body 100. The end piece 211 of the shaft 210 is arranged to project outside the end plate 202 in question, and this end plate is fitted at least partly into the passage 31 in such a manner that this end plate is close to the chamber 110. As a result, this end plate can be ventilated and cooled without a partition intercepting the flow of air agitated by the bladed wheel.

When a motor-driven pulsator according to the invention is connected to its distribution circuit, the position occupied by its connector 220 may pose problems of access. This is the case in particular when such a motor-driven pulsator is placed in the engine compartment of a motor vehicle. In order to facilitate access to the connector and electrical connection, it is then possible to act on the securing elements 33 in such a manner as to separate momentarily the turbine and the electric motor and disengage the orientation means 32 so as to adjust the relative positions of the casing and the body in order to make the connector accessible or free it from the proximity of the engine components which would not permit unrestricted access thereto. This orientation may be preset and selected in the workshop as a function of the type of vehicle to be equipped or may be determined only at the moment of installation of the motor-driven air pulsator in a particular vehicle.

As can be observed clearly, the technique according to the invention firstly permits, once the electric motor is finished, fitting of the bladed wheel or air-agitating member onto the end piece of the electric motor shaft. Once fitted, this air-agitating member can be positioned accurately and fixed axially in translation on the end piece with the aid of any appropriate techniques, such as riveting, screwing, welding, compression or the like, such that at least one of its axial faces is located at a distance from that end plate of the motor which is closest to it, which is within the predetermined tolerance range. This can be performed easily, for example, with the aid of gauges as is known. Once this is done, either or both of the axial faces of the air-agitating member can be dressed, in this case the outer faces of the base and the collar, so as to make them perpendicular to the axis of rotation of the shaft and so as to situate them at the nominal distance from this end plate, allowing for machining accuracy. When the motor has been thus equipped with the air-agitating member and after static and dynamic balancing if required, it can be positioned on the turbine distributor body by fitting this air-agitating member 12 into the passage 31 of the mounting arrangement. As has been indicated, the external diameter $\phi_e$ of the cylinder in which the bladed wheel is inscribed and the internal diameter $\phi_i$ of the cylinder in which the internal surface 310 of this passage is inscribed are such that the air-agitating member can be introduced into this passage by a translation parallel to the axis Δ(delta). As has been noted, this passage is open at both ends, thereby permitting the direct insertion of the air-agitating member into the chamber. Following this, the electric motor and the distributor body are appropriately oriented relative to this axis in order to give them the assigned position. This end plate can then be brought to bear against the body and they can be fixed to one another in order to maintain them in this position with the aid of the securing elements.

Embodiments have been described and illustrated in which the air-agitating member is a bladed wheel. It is clear that the invention is also applicable to cases in which this air-agitating member is a helical wheel.

Preferably, the distributor body is made of synthetic material and produced, for example, by moulding. This body is preferably moulded integrally or preassembled in one piece.

Preferably, the air-agitating member is made of synthetic material and produced, for example, by moulding. As is readily understood, the choice of structure adopted according to the invention permits the production of this air-agitating member using a mould in only two parts, a punch and a die which fit together and are released simply by a simple translational movement, and this taking place without it being necessary to use cores which are movable or otherwise.

As for the motor, preferably at least that end plate thereof which is in contact with the distributor is metal.

From the above, it will be understood that all the problems of tolerance and the difficulties which result from the increase in dimensions have been eliminated, since the junction of the turbine and the motor is effected in a plane which is defined, on the one hand, by a face of an end wall of the body and, on the other hand, by a face of an end plate of the casing and since these faces serve as reference surfaces for adjusting the dimensions, and therefore assembly problems are eliminated since the final assembly is preceded by a partial assembly.

In addition to all these advantages, it will be observed that, by virtue of the invention, in the event of a failure of the electric motor it is easy to use a standard replacement without it being necessary to engage in tedious operations.

I claim:

1. A motor-driven air pulsator for motor vehicles susceptible of being mounted in a motor vehicle engine compartment comprising, a turbine rotor for delivery of air, an air distributor defining a chamber within which the turbine rotor is insertable and removably housed for rotation therein, said air distributor having end walls having an air inlet and an opening into said chamber through which the turbine rotor is inserted axially into said chamber for being housed therein and removed therefrom, said air distributor having an air outlet connectable to an air distribution system for delivery of air by said turbine rotor, said turbine rotor having elongate blades extending axially thereon and spaced in a circumferential direction of said turbine rotor, an orientation element mounted on a sidewall of said air distributor having said opening and disposed exteriorly thereof for introduction of said turbine rotor into said chamber in assembling said turbine rotor with said air distributor and defining therein an internal open-ended cylinder in communication with said opening and coaxial therewith communicating with the interior of said chamber for orienting and accurately locating of the turbine rotor axially and radially within said air distributor in a position relative to internal wall surfaces thereof defining said chamber to effectively optimize close clearances between said turbine rotor and said internal wall surfaces thereby to optimize said delivery of air, said open-ended cylinder projecting longitudinally away from said air distributor disposing an open end thereof axially spaced from the air distributor having said opening to provide access for insertion of said turbine rotor axially into said open-ended cylinder for guiding translation of said turbine rotor therethrough accurately into and out of said chamber, said open-ended cylinder having an internal diameter relative to an outer diameter of said turbine rotor and an axial length for effectively guiding and maintaining the longitudinal axis of the turbine rotor coaxial with said open-ended cylinder and said opening during translatory introduction of said turbine rotor axially through said open-ended cylinder and said opening into said chamber, an electric motor having a drive shaft and a casing and bearings rotatably mounting said drive shaft for connection to said turbine rotor, said casing having an end plate thereof removably mounted on said open-ended cylinder covering said open-end thereof and in communication with said chamber for receiving air from said turbine rotor and effectively mounting said turbine rotor in said position accurately radially and axially in said chamber, whereby the electric motor casing is cooled by air delivered by said turbine rotor.

2. A motor-driven air pulsator for motor vehicles according to claim 1, in which said end plate of said electric motor casing has means cooperative with said orientation element for variably positioning said casing end plate selectively at different angular fixed positions relative to a longitudinal axis of said open-ended cylinder prior to mounting said air pulsator in said vehicle or when mounting said turbine rotor and electric motor on said air distributor while in said vehicle.

3. A motor-driven air pulsator for motor vehicles according to claim 2, in which aid means cooperative with said orientation element comprises an axial protuberance disposed on said end plate of said electric motor and said orientation element has a recess for receiving said protuberance when said electric motor and said turbine rotor are assembled with said air distributor.

4. A motor-driven air pulsator for motor vehicles according to claim 1, in which said air distributor comprises an involute defining an air discharge path tangential to the turbine rotor and defining said air outlet.

5. A motor-driven air pulsator for motor vehicles according to claim 1, in which said turbine rotor has an axial bore for receiving said drive shaft of said electric motor for assembly thereto and disassembly therefrom.

6. A motor-driven air pulsator for motor vehicles according to claim 1, including means for removably mounting said orientation element and open-ended cylinder thereof on said air distributor extending longitudinally therefrom.

* * * * *